US007278187B2

(12) United States Patent
Petersen

(10) Patent No.: US 7,278,187 B2
(45) Date of Patent: Oct. 9, 2007

(54) MANUFACTURE OF A MULTI-LAYER FABRIC

(75) Inventor: Jens Erik Thordahl Petersen, Rønde (DK)

(73) Assignee: Dan-Web Holding A/S, Risskov (DK)

( * ) Notice: Subject to any disclaimer, the term of this patent is extended or adjusted under 35 U.S.C. 154(b) by 416 days.

(21) Appl. No.: 10/927,513

(22) Filed: Aug. 27, 2004

(65) Prior Publication Data

US 2006/0042049 A1 Mar. 2, 2006

(51) Int. Cl.
*D01G 25/00* (2006.01)

(52) U.S. Cl. ..... 19/302

(58) Field of Classification Search ..... 19/296, 19/302; 28/103; 156/148
See application file for complete search history.

(56) References Cited

U.S. PATENT DOCUMENTS 4,236,962 A * 12/1980 Kankaanpaa ..... 162/204
4,950,444 A 8/1990 Deboufie et al.
5,093,963 A * 3/1992 Farrington et al. ..... 19/296
5,167,738 A 12/1992 Bichot et al.
6,375,773 B1 * 4/2002 Andersen ..... 156/148
6,675,445 B2 * 1/2004 Naber et al. ..... 19/296
6,851,164 B2 * 2/2005 Andersen ..... 28/104
2006/0230589 A1 * 10/2006 Christensen ..... 28/117

FOREIGN PATENT DOCUMENTS

GB 2173523 10/1986
WO WO 01/14624 3/2001

* cited by examiner

*Primary Examiner*—Shaun R. Hurley
(74) *Attorney, Agent, or Firm*—James Creighton Wray; Clifford D. Hyra

(57) ABSTRACT

A method and an apparatus for manufacturing a multi-layer fabric including at least one fibre layer formed by airlaying combined with at least one further layer which is formed by different technologies, including carding, spunlacing, meitblowing, spunbonding, or airlaying, or combined with one or more films. The airforming is performed on a separate formerwire which is applied vacuum via a suction box disposed opposite to a formerhead, and where the airformed fibre layer is transferred to a conveyor wire for joining with a further layer. Edge trimming is performed at least on the airformed layer before it is joined with one or more other layers for forming the multi-layered fabric. Scrap from edge trimming and exhaust from the suction box is returned to the formerhead.

12 Claims, 11 Drawing Sheets

PRIOR ART

MANUFACTURE OF A MULTI-LAYER FABRIC

BACKGROUND OF THE INVENTION

The present invention concerns a method for manufacturing a multi-layer fabric, including at least one fibre layer formed by airlaying combined with at least one further layer which is formed by different technologies, e.g. carding, spunlacing, meltblowing, spunbonding, airlaying, or combined with one or more films, and where the airforming is performed on a separate formerwire which is applied vacuum via a suction box disposed opposite to a formerhead, and where the airformed fibre layer is transferred to a conveyor wire for joining with additional layers.

The invention also concerns an apparatus for manufacturing a multi-layer fabric including at least one fibre layer formed by airlaying combined with at least one further layer which is formed by various technologies, e.g. carding, spunlacing, meltblowing, spunbonding, airlaying or combined with one or more films, and where an airlaying unit including a formerhead and a suction box are associated with a separate formerwire, which apparatus including a conveyor wire upon which a plurality of layers can be combined with the airformed fibre layer, as several layer forming units are associated.

It is prior art to manufacture a fabric with one or more fibre layers which are formed on a formerwire or several succeeding formerwires. The manufacture may occur by using carding units or formerheads.

By making multi-layer fabrics, it is often desirable to combine fibre layers with different properties, so that the finished fabric appears as an integrated product with different properties, e.g. varying density across the thickness of the fabric or varying liquid penetration properties.

By making products with several layers as an integrated product formed by several fibre layers, a problem with attachment form the suction box or boxes disposed under a formerwire will arise. When several formerheads are disposed in succession, the layer thickness at the last formerhead in a sequence of layers will be exposed to very little suction action, since the vacuum effect has difficulty in penetrating through the already formed fabric. Therefore, it is usually necessary to work with differentiated suction boxes under the formerwire in order to establish greater and greater vacuum in the forward direction of the formerwire.

It may also be necessary to reduce the conveying speed of the formerwire for achieving sufficient vacuum effect through the formed fabric. This implies a reduced effect for the apparatus.

In recent years it has become popular to combine different technologies in order to manufacture multi-layer products having different desirable properties, depending on the intended application. It has thus been popular to combine carding, spunlacing, meltblowing, spunbonding and airlaying. In FIG. 1 is shown a typical example of a known plant where a combination of carding, spunbonding, airlaying, carding and spunlacing are used for forming a product which is then rolled up.

By such typical known apparatuses there will thus be used a card that lay a pile of carded fibres. These fibres can have lengths between 30 and 60 millimetres and may be synthetic fibres or natural fibres. The card layer is pre-treated by pre-spunlacing, implying that the establishing of so-called hydroentanglement by a water jet system. Thereby, the fibres are crumpled and imparted strength. However, the product is wet due to the hydroentanglement. Therefore, it is necessary to pass the product through a dryer in order to evaporate the water before the fabric is then transferred to a formerwire on which is mounted an airlaying unit, including a formerhead and a suction box which is disposed opposite to the formerhead at the opposite side of the formerwire.

As alternative to spunlacing and drying in a drying facility, hot calandering or vacuum suction may also be used. By the calandering it becomes possible to provide compression and fixation of the fibres. Typically it becomes possible to lay fibre layers in an amount between 10 and 30 g/m$^2$ upon the carding layer.

By the known process, a multi-layer web may thus be formed. The suction box is thus to suck through the formerwire and the fabric provided thereon. This implies a resistance to be surmounted, requiring greater efficiency in the suction than otherwise needed. It will thus be necessary with a greater vacuum, and greater wear will occur on the formerwire.

It is possible to lay a further carding layer. Alternatively, one may omit the further carding layer, so that a double layer fabric is formed. Subsequently, the multi-layer fabric is passed to spunlacing where a water jet system is used for hydroentanglement or hydroentanglement as was the case with pre-spunlacing. An integrated product will then be formed which is passed through a dryer before rolling up is performed.

If a double-layer structure is formed, it will e.g. be possible to make the fabric with a viscose side and a cellulose side. It will be possible to make a product, where one side is rough and the other side is smooth. However, a dust problem may appear here as compared with a three-layer product, where a carding layer is laid upon the two previously formed layers.

The known apparatus and the known method are disadvantageous in relation to adjustment of width. When the airlaying unit is to be adjusted for regulating the width of the formed web in relation to the width of the one formed by the card, it will usually be necessary to stop the apparatus for performing a width adjustment.

If one desires to trim the edge of the fabric, it is not possible to reuse the scrap from this edge trimming, as it contains long and short fibres.

Furthermore, the known system seems to be disadvantageous, as the suction boxes provided under the formerwire, will receive a mixture of the airlaid fibres and the long fibres from the card. This will typically be a mixture of cellulose fibres and long fibres. This mixture will be extracted in a filter, and it will not be possible to reuse the fibres in the formerhead. We are thus speaking of scrap material. Furthermore, it will also be possible to perform a large dimensioning of filters, moisturisers and suction boxes due to the difference in the need for difference over the fabric/formerwire.

Furthermore, the known systems will also imply drawbacks in the form of waste at the subsequent rolling-up. It will thus be necessary to make the carding layer with a greater width for overlapping the cellulose layer. If the reverse was the case, one would risk clogging of the vacuum drums/suction tables in the spunlacing system. During hydroentanglement, the short cellulose fibres will end in the water cleaning system and obstruct nozzles and filters therein if they are at a position outside the carding layers.

In short it may be said that the known systems for making multi-layer fabrics, where a combination of different technologies were used for the individual layers, are energy demanding and require greater dimensioning of the plant and furthermore may imply reduced capacity for the manufacturing apparatuses.

It is the purpose of the invention to provide a method and an apparatus which enable making a multi-layered product by combining an airformed layer with one or more other webs, and which require limited energy and provides the possibility of reducing waste in the production by extensive recycling of fibre material.

According to the present invention, this is achieved by a method which is peculiar in that edge trimming is performed at least on the airformed layer before it is joined with one or more other layers for forming the multi-layered fabric, and that the scrap from edge trimming and exhaust from the suction box is returned to the formerhead.

An apparatus according to the invention is peculiar in that the airlaying unit includes means for edge trimming of the airformed fibre layer formed on the separate formerwire, and that outlet from the suction box and means for collecting the scrap from edge trimming are connected with the formerhead for returning fibres.

With a method and an apparatus according to the invention, it is possible to achieve high production speeds, even by formation of multi-layered fabrics.

By the present invention it thus becomes possible not only to form an airlaid layer on a particular and suitable formerwire on which may be mounted one or more former units that possibly may be of different types. Furthermore, it is also possible to reduce waste as the scrap from edge trimming of the airformed layer may be returned to the formerhead.

After formation of the airformed fibre layer, this is laid upon a subsequent transport wire, either by being laid upon an already provided layer, or for then to be provided with an already provided layer or for then to be provided with a layer upon it or by performing a combination thereof for forming a multi-layer fabric. The layers with which the airformed layer is combined may be of any type irrespectively of whether they are permeable or not. There may thus be used layers formed by film, tissue, non-woven etc. It is also possible that the further layer or layers appear wet or pre-glued.

When forming certain products from the multi-layer fabric, it may be an advantage to lay the airformed fibre layer on a layer which is wet and pre-spunlaced. The pulp fibres will then absorb liquid whereby it becomes possible to increase the size of the fibres. This process can be an advantage as one may hereby reduce wash-out of the pulp fibres by subsequent spunlacing of the formed multi-layer fabric. The pulp fibres will usually be formed of cellulose fibres. However, the pulp fibres may also include synthetic fibres, including thermobonding fibres. The airformed fibre layer from one or more formerheads may thus be heat treated via an oven if there are provided thermobonding fibres or other types of fibres having properties affected by subjection to heat. It is also possible to moisturise the airformed fibre layer before a subsequent compacting before the airformed layer is transferred to the conveyor wire.

With the system according to the present invention it thus becomes possible to reduce operational costs and at the same time to achieve renewed flexibility for using an apparatus for forming a greater variation of the product without the risk of reducing the efficiency of the apparatus.

According to a further embodiment, the method is peculiar in that the airformed fibre layer is compacted, possibly after prior moisturising, before it is joined with the other layer or layers. Hereby it becomes easier to handle the fibre layer by the subsequent treatment. Furthermore, the compacting may also be used for imparting a desired property to the fibre web.

According to a further embodiment, the method is peculiar in that the airformed fibre layer is sucked from the separate formerwire and is returned to the formerhead at initiation/shutdown of the manufacturing process. The waste is further reduced as not only scrap from edge trimming is reused but also of the material airformed during running-in and slowing down of the production process.

According to a further embodiment, the method is peculiar in that at least one web of a permeable material is laid upon the formerwire for forming an at least double layered fabric on the formerwire. On the formerwire may hereby be formed a double layered fabric. The additional web may optionally be laid before or after the formerhead, as seen in the conveying direction of the formerwire.

According to a further embodiment, the method is peculiar in that the airformed fibre layer is formed at the upper side of an upper run of the formerwire, and that the fibre layer is passed downwards and along the underside of the lower run of the formerwire in order to be laid off on the subsequent conveyor wire together with at least one other web for forming a fabric with at least two layers. A simple method is hereby achieved whereby is produced a fabric in which the airformed fibre layer is laid with the side that has been in contact with the formerwire facing outwards, away from the other web and the conveyor wire.

According to a further embodiment, the method is peculiar in that the individual layers joined on the conveyor wire are integrated by a suitable succeeding process, which e.g. includes hydroentanglement, spunbonding, thermobonding or calandering. It is thus possible to perform more or less integration of the entire fabric or parts thereof by a method which is optimal compared with the properties in the individual layers and compared with the desired properties in the end product.

According to a further embodiment, the method is peculiar in that an individual edge trimming of individual layers is performed before they are joined on the conveyor wire. Waste of material/fibres for all layers is hereby reduced, as scrap from each of the individual edge trimmings is returned for recycling without being mixed together with material/fibres from the other layers.

According to a further embodiment, the apparatus is peculiar in that there is provided a compacting unit, and optionally also a moisturising unit, immediately after the airlaying unit on the separate formerwire. By this apparatus it becomes possible to compact the airformed fibre layer before it is brought together with that layer or the other layers.

According to a further embodiment, the apparatus is peculiar in that a suction unit is provided at the separate formerwire, and that an outlet from that is connected with the formerhead. The suction unit will preferably extend across the width of the web laid by the formerhead. It may be divided into sections for only covering parts of that width. The suction unit maybe used for sucking all fibres during start and stop of the apparatus for returning these to the formerhead and thereby save material.

According to a further embodiment, the apparatus is peculiar in that in connection to the formerhead, a unwinding unit is provided for laying a web on the separate formerwire, so that thereupon is formed an at least double-layered fabric. It is thus possible to adapt the apparatus so that a multi-layered fabric is formed on the formerwire before transfer to the conveyor wire. The apparatus hereby becomes more flexible and may be used for making a wide range of products.

According to a further embodiment, the apparatus is peculiar in that the formerhead used by forming the airformed fibre layer, that at least one formerhead is disposed at the upper side of the upper run of the formerwire, and that a vacuum box is provided between the upper and lower runs of the formerwire so that the fibre layer is passed downwards and along the underside of the lower run of the formerwire in order to be laid off on the subsequent conveyor wire together with at least one other web for forming a fabric with at least two layers. The apparatus may hereby be used for producing a fabric in which the airformed fibre layer is laid with the side having been in contact with the formerwire facing outwards, away from the other web and the conveyor wire.

DESCRIPTION OF THE DRAWING

The invention will now be explained more closely in the following with reference to the accompanying schematic drawing, where.

In the following, identical or corresponding elements repeated in different Figures will be denoted with the same reference number. Thus explanation for each single constructional feature will not be provided in connection with each of the Figures. Instead, an explanation will be given to the points whereby the different embodiments for the apparatus according to the invention are differing from each other.

Figure 1:
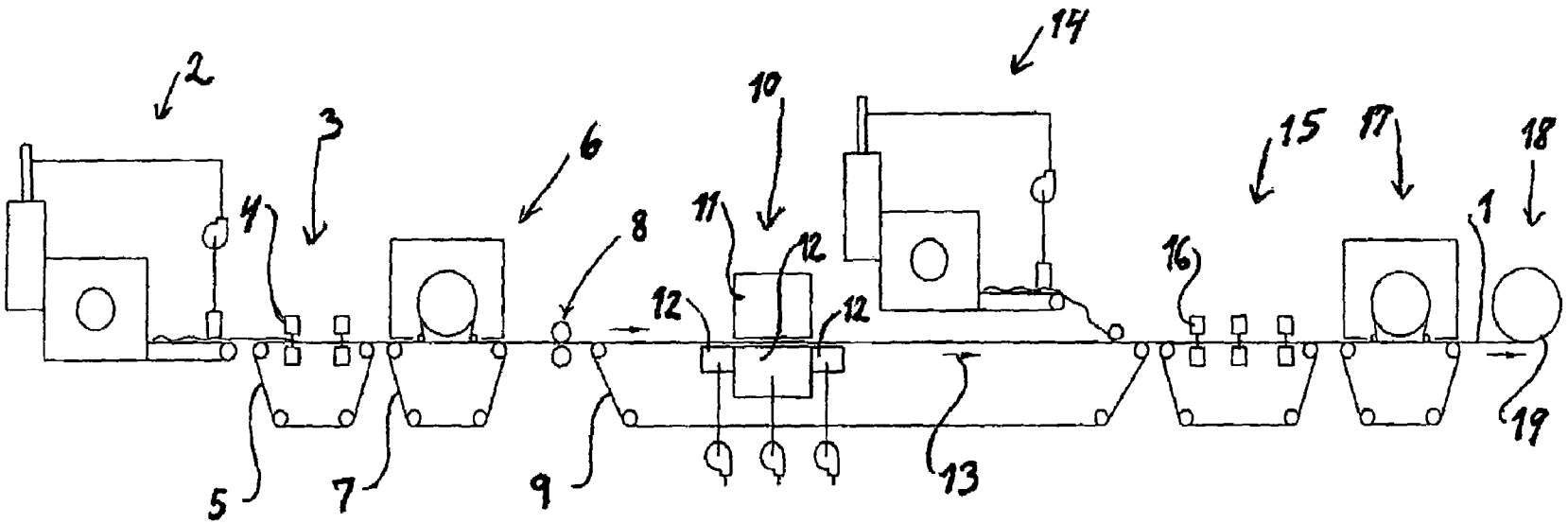
FIG. 1 shows an elementary sketch of a typical plant according to prior art, where a combination of carding, airlaying and spunlacing is used in making a multi-layer fabric.

FIG. 1 shows a typical prior art plant for forming a multi-layer fabric 1. The plant consists of a first card 2 that lays a web of carded fibres which typically are synthetic fibres with lengths between 30 and 60 mm. After the card 2, a spunlacing unit 3 is situated, having a number of water jet units 4. The spunlacing unit 3 includes a conveyor wire 5 upon which the formed carding layer is conveyed during hydroentanglement. Then there is provided a drying unit 6 for evaporating water in the formed carding layer. The drying unit includes a conveyor wire 7 used for conveying the formed carding layer.

After the drying unit 6 there is a calander 8. The calander 8 may be used in general as alternative to spunlacing and the drying unit 6 for achieving calandering simultaneously with hot bonding of the fibres in the formed layer. The layer is then moved over to a formerwire 9 where an airlaying unit 10 is provided which includes a formerhead 11 disposed opposite to suction boxes 12 with the conveyor belt 9 moved there between. An arrow 13 presents the conveying direction of the conveyor belt 9.

After the airlaying unit 10 there is provided a further card 14 for laying a further carding layer that substantially corresponds to the carding layer laid by the card 2. Hereby is formed a three-layered product which subsequently is conveyed to the further spunlacing unit 15 where hydroentanglement occurs with the purpose of integrating the formed multi-layer fabric 1 by using a water jet system 16. The hydroentangled fabric is then passed through a further dryer 17 for lastly being moved to a winding unit 18 for forming a roll 19 of the finished multi-layer fabric.

In the following, explanation to the different embodiments of the apparatus according to the invention will be given.

Figure 2:
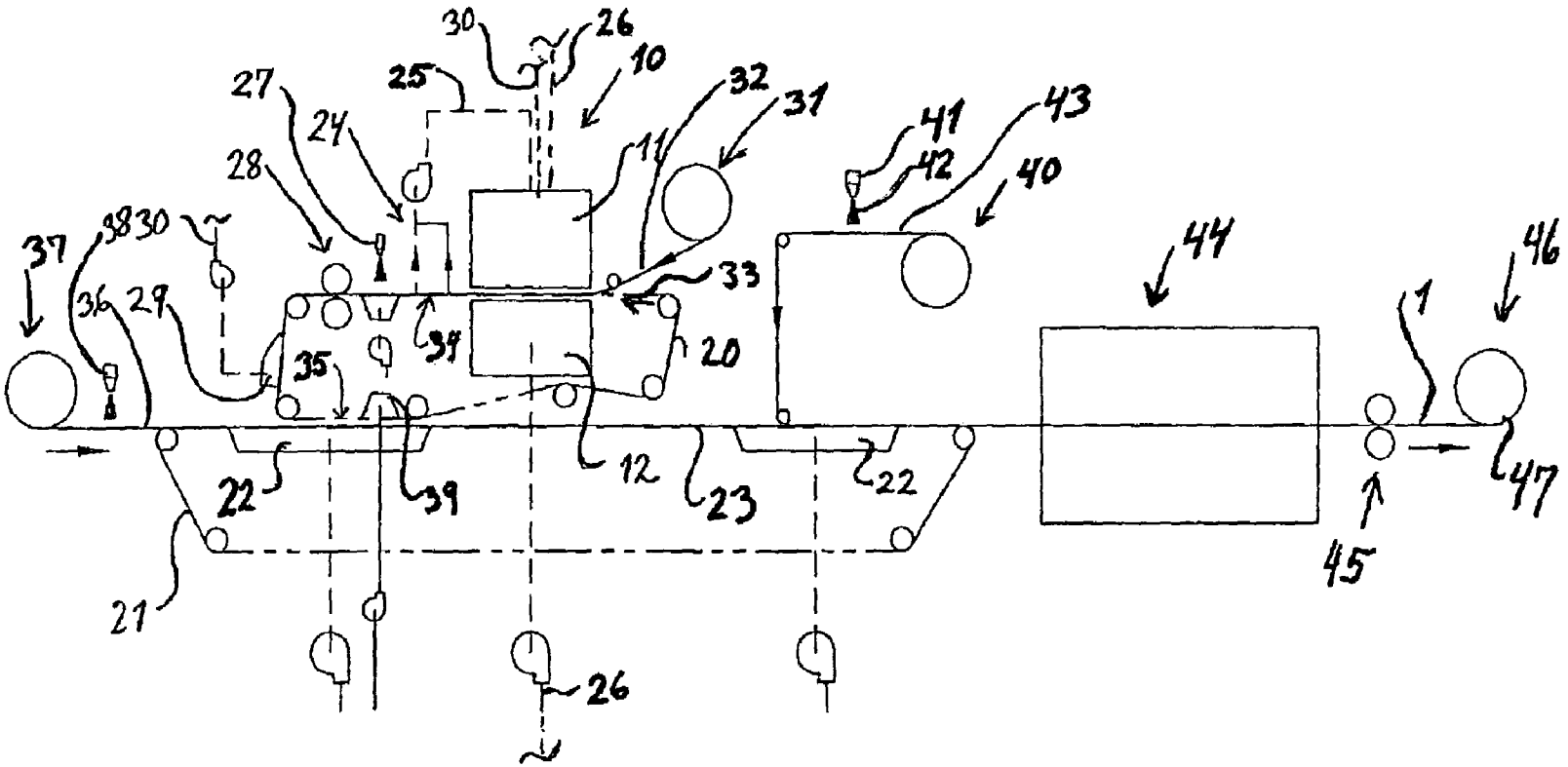
FIG. 2 shows an elementary sketch of a first embodiment of an apparatus according to the invention.

In FIG. 2 is seen an embodiment where there is provided an airlaying unit 10, including a formerhead 11 and a suction box 12 associated with a formerwire 20. A conveyor wire 21 is provided under the formerwire 20. Suction boxes 22 are provided under the upper run 23 of the conveyor wire 21. The airlaying unit 10 includes edge trimming means 24 which via a return run 25 moves scrap from edge trimming back to the formerhead 11. Correspondingly, there is a return run 26 from the suction box 12 to formerheads 11.

In association with the formerwire 20, immediately after the airlaying unit 10, there is provided moisturising means 27 and a compacting unit 28. Furthermore, at the formerwire 20 there is provided a suction unit 29 which via a return run 30 is connected with the formerhead 11 in order to suck and return fibres at start and stop of a process.

In the shown embodiment there is furthermore provided a unwinding unit 31 which unwinds a layer 32 on the formerwire 20 at a position in front of the formerhead 11. It is noted that the formerwire 20 has a conveying direction according to the arrow 33. The unwinding unit 31 is optional and may be omitted. Alternatively, the unwinding unit 31 may be disposed after the formerhead 11.

According to a further alternative embodiment, unwinders 31 may be provided before as well as after the formerhead 11. It will also be possible to provide several succeeding formerheads 11 above the upper run 34 of the formerwire 20. In such a situation it is preferred that each of the formerheads constitutes a part of separate airlaying units 10 which are associated with their separate edge trimming means 24.

The airformed fibre layer from the formerwire 20 is passed downwards and along the lower run 35 of the formerwire 20. The airformed fibre layer is here joined with a layer 36 coming from an unwinding unit 37. The layer 36 may be formed in different ways, e.g. it may be carded, meltblown, spunblown, airblown or possibly it may be an impervious film. The layer 36 is passed by a gluing station 38 where glue is applied for bonding the layer 36 together with the airformed fibre layer.

In connection with the conveyor wire 21, a blow-down box 39 is provided. This is used for pressing the airformed fibre layer down on the web 36 if this is made of an impervious material.

In connection with the conveyor wire 21 is illustrated a further unwinder 40 from which a further layer 43 of non-woven material, film or similar may be unwound.

Associated therewith is also provided a second gluing station 41 that applies glue 42 on the further layer 43 which is unwound from the unwinding station 40. As alternative to the unwinding station 40, a card forming the layer 43 may also be used here. The joined multi-layer fabric 1 is then passed through a drying unit or oven 44 or alternatively a calander 45, after which it is moved to a winding unit 46 for forming a roll 47 of the multi-layer fabric 1.

When starting the manufacturing process, there is started with unwinding the first layer 36 and at the same time, the airlaying unit 10 is started up. At the beginning there will be a running-in until a controllable layer of airformed fibres appears. Therefore, the suction unit 29 is started so that the fibres are returned to the formerhead 11. When the plant has been started and a controlled layer is laid, the suction unit 29 is switched off and the making of the multi-layer unit 10 is initiated. If there is used carding units together with the airlaying unit 10, by commencing carding fibres may also be returned until the carding layer is laid in a controlled way. When a satisfactory layer formation has been established in the carding unit and the airlaying unit, formation of the multi-layer fabric is initiated as suction units are stopped.

At the outlet of each carding unit at the prior art plants, a return run will be located. Until the carding unit has been properly started and forms a controlled layer, all the fibres will be returned. Such a returning of the fibres to the carding layer will also be possible in a plant of which an apparatus according to the invention forms a part.

The products that may be formed may e.g. be wet wipes that consist of two layers with non-woven at the outer sides and a layer formed there between of airformed absorbing fibres. This airformed fibre layer may include bicomponent fibres, monocomponent fibres, cellulose fibres or possible combinations thereof.

It is also possible to make one layer as a film that may act as a top layer, where the second layer was non-woven material, while the centre lay could be an absorbing core. It will thus be possible to form a multi-layer fabric which then can be punched for forming incontinence products or other absorbing products which are provided with an external layer of film and non-woven and a centre core which is absorbing.

Figure 3:
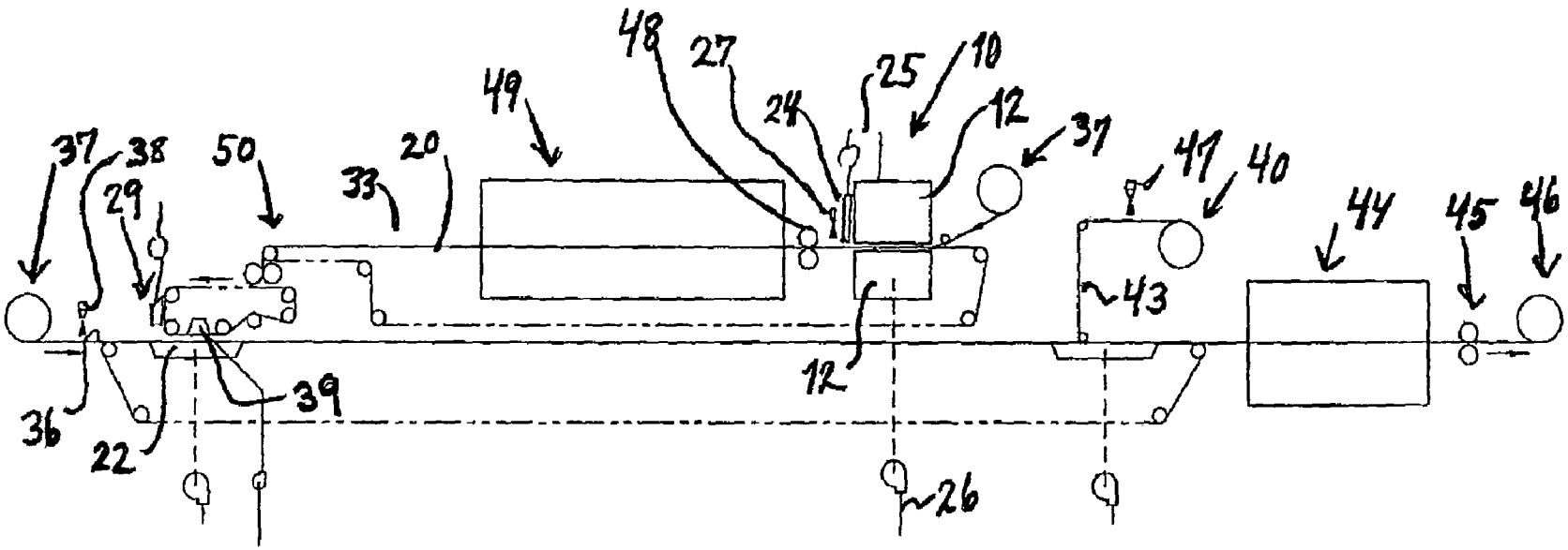
FIG. 3 shows an elementary sketch of a second embodiment of an apparatus according to the invention.

The embodiment illustrated in FIG. 3 corresponds in principle to the embodiment of the apparatus shown in FIG. 2. When an airformed fibre layer containing bicomponent fibres is made, these may be passed through a calander 48 and/or an oven 49 and a subsequent calander 50. Hereby it becomes possible to provide an airbonded and calandered layer before it is laid upon the conveyor belt 21. The embodiment of the apparatus shown in FIG. 3 will thus be suited for making a product where the airformed fibre layer is a thermally formed product which is bonded in a oven and calandered for finally being cooled down and then laid on the layer 36 on the conveyor wire 21.

In the embodiment illustrated in FIG. 3, as alternative to unwinding units 37 and 40 there may also be used carding units with and without spunlacing, and fabric formed by meltblowing, spunbonding or other fibre laying methods which also can be with or without hydroentanglement by means of water jets.

In the formerheads 10 different combinations of fibres may also be used in this embodiment. The supply may thus include pulp/cellulose, bicomponent fibres, split fibres, curled fibres, thermoplastic fibres or other fibres which are used by airlaying processes.

Figure 4:
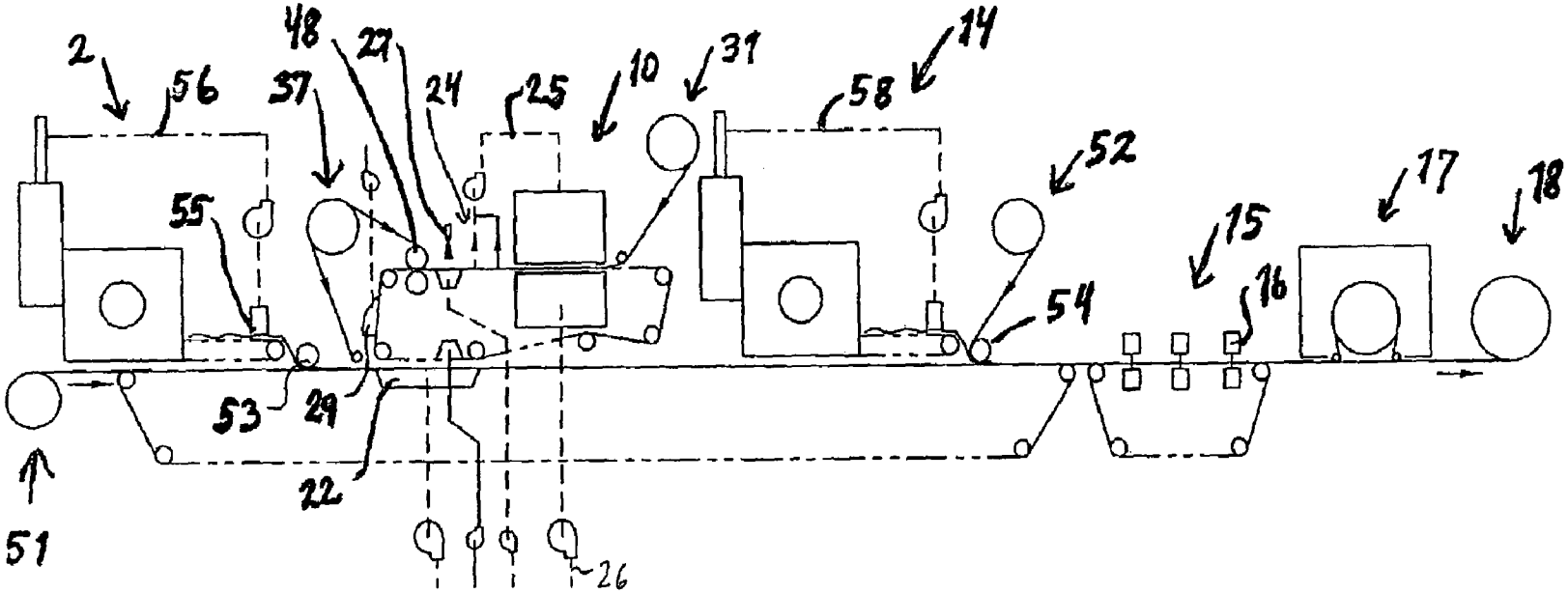
FIG. 4 shows an elementary sketch of a third embodiment of an apparatus according to the invention.

FIG. 4 shows a third embodiment of an apparatus according to the invention. This may be said to be a further development of the apparatus shown in FIG. 3 by the provision of a first carding unit 2 and a further carding unit 14 before and after the airlaying unit 10. These further carding units 2, 14 may be compared with the carding units shown in FIG. 1.

In this embodiment, further unwinding units 51, 52 before the carding unit 2 and after the carding unit 14, respectively, have been provided. Furthermore, after each of the two carding units 2, 14, there has been provided a vacuum roller 53 and 54, respectively. The multi-layer fabric formed on the conveyor belt 21 is thus made dry until it comes to the spunlacing unit 15. From the unwinding unit 37, a layer may optionally be passed through the compacter 48 for being joined with the airformed fibre layer or be passed directly to the conveyor belt without passing through the calander 48.

With this apparatus, there is thus formed a multi-layer product 1, which is not pre-spun bonded, as the airformed layer is laid down upon a loose pile from the carding unit 2, and likewise a loose pile will be laid down from the carding unit 14.

Firstly, an integration of the layers by the spunlacing performed in the spunlacing unit 15 occurs. Then the multi-layer fabric is dried and rolled up.

It is possible to use all unwinders, carding units and airforming units in order to form a multi-layer product, or alternatively, just some of the layer forming units may be used, e.g. for forming a two-, three-, four-, five- or six-layered product.

The alternative guiding of the layer from the unwinder 37 can be used for a non-woven layer that includes bicomponent fibres. Such a layer may advantageously be unwound so that it runs through the calander 48 so that the layer is in fact laminated down on the airformed fibre layer coming from the airlaying unit 10. Hereby bonds are established between the non-woven layer and the airformed fibre layer. It may be said that it becomes possible to perform a so-called calandering bonding where a laminate or a bonding is established before the airformed layer is laid down on the conveyor belt 21. By using the unwinding unit 37 and the unwinding unit 31, it is thus possible to form a product with three layers on the formerwire 20.

Furthermore, it is noted that the carding unit 2 is provided with means 55 for edge trimming so that fibres, via a return run 56, is returned to the carding unit. In the same way, the carding unit 14 is provided with means 57 for edge trimming so that fibres via return run 58 are returned to the carding unit 14.

For the sake of completeness it is noted that as alternative to the carding unit there may be applied units for meltblowing, spunbonding or other web forming methods.

For each of the individual layer forming units there may be provided individual edge trimming means that enable material savings by returning of the fibres.

Figure 5:
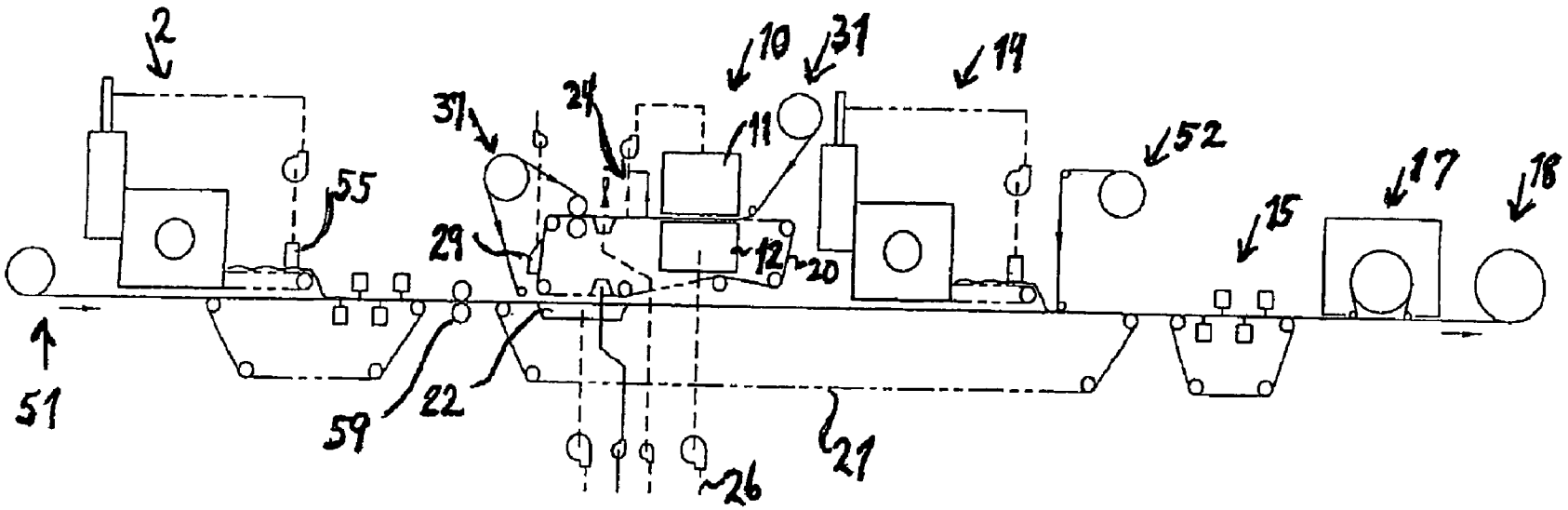
FIG. 5 shows an elementary sketch of a fourth embodiment of an apparatus according to the invention.

The embodiment according to FIG. 5 corresponds in principle to that shown in FIG. 4.

It differs in that a spunlacing unit 3 and a calander 59 are provided after the carding unit 2. This means that it is possible to use either the calander 59 or the spunlacing unit 3 only for hydroentanglement or calandering the formed layer.

With this apparatus, a wet layer will be formed, and thus it becomes possible to lay the airformed fibre layer on a wet layer. As mentioned before, it has the advantage that the fibres from the airformed layer grow thereby, so that there is no risk of carrying along of the short fibres at the subsequent spunlacing before rolling up of the finished multi-layer fabric.

Figure 6:
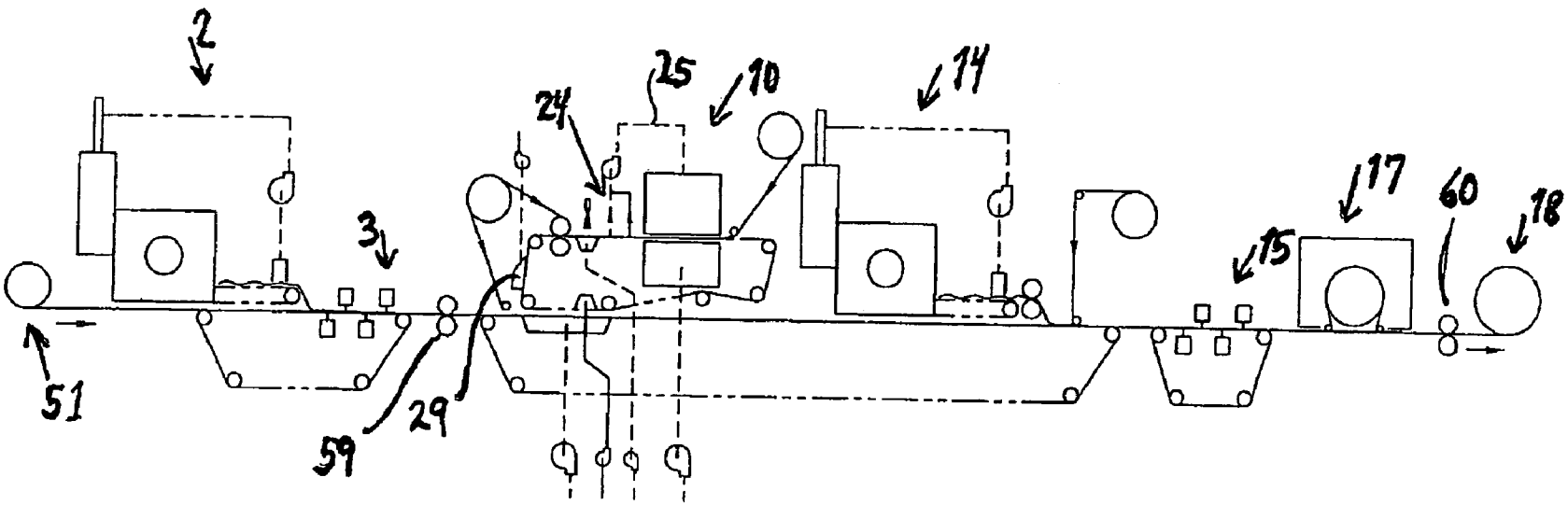
FIG. 6 shows an elementary sketch of a fifth embodiment of an apparatus according to the invention.

FIG. 6 shows a fifth embodiment of an apparatus which in principle corresponds to the apparatus shown in FIG. 5. The only difference is the disposition of a calander 60 after the last dryer 17. By such an apparatus it becomes possible to provide the multi-layer fabric 1 with an embossing calandering or to make it a very thin product.

Figure 7:
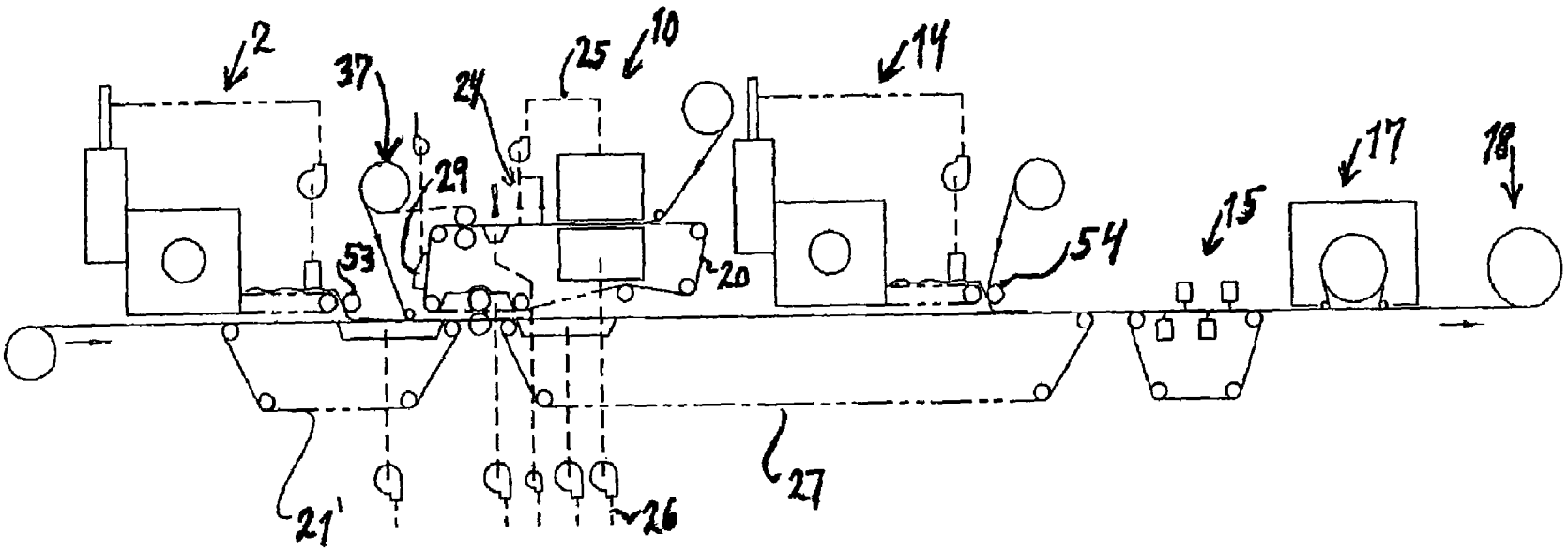
FIG. 7 shows an elementary sketch of a sixth embodiment of an apparatus according to the invention.

FIG. 7 shows a sixth embodiment of the apparatus where the conveyor wire is provided in the form of two succeeding conveyor wires 21' and 21", respectively. The airformed layer together with a previously formed layer from the carding unit 2 is passed through the embosser 61. The fabric is produced dry, and firstly a complete integration of the layers in the spunlacing unit 15 is formed. In principle, this corresponds to the principle illustrated in FIG. 4.

Figure 8:
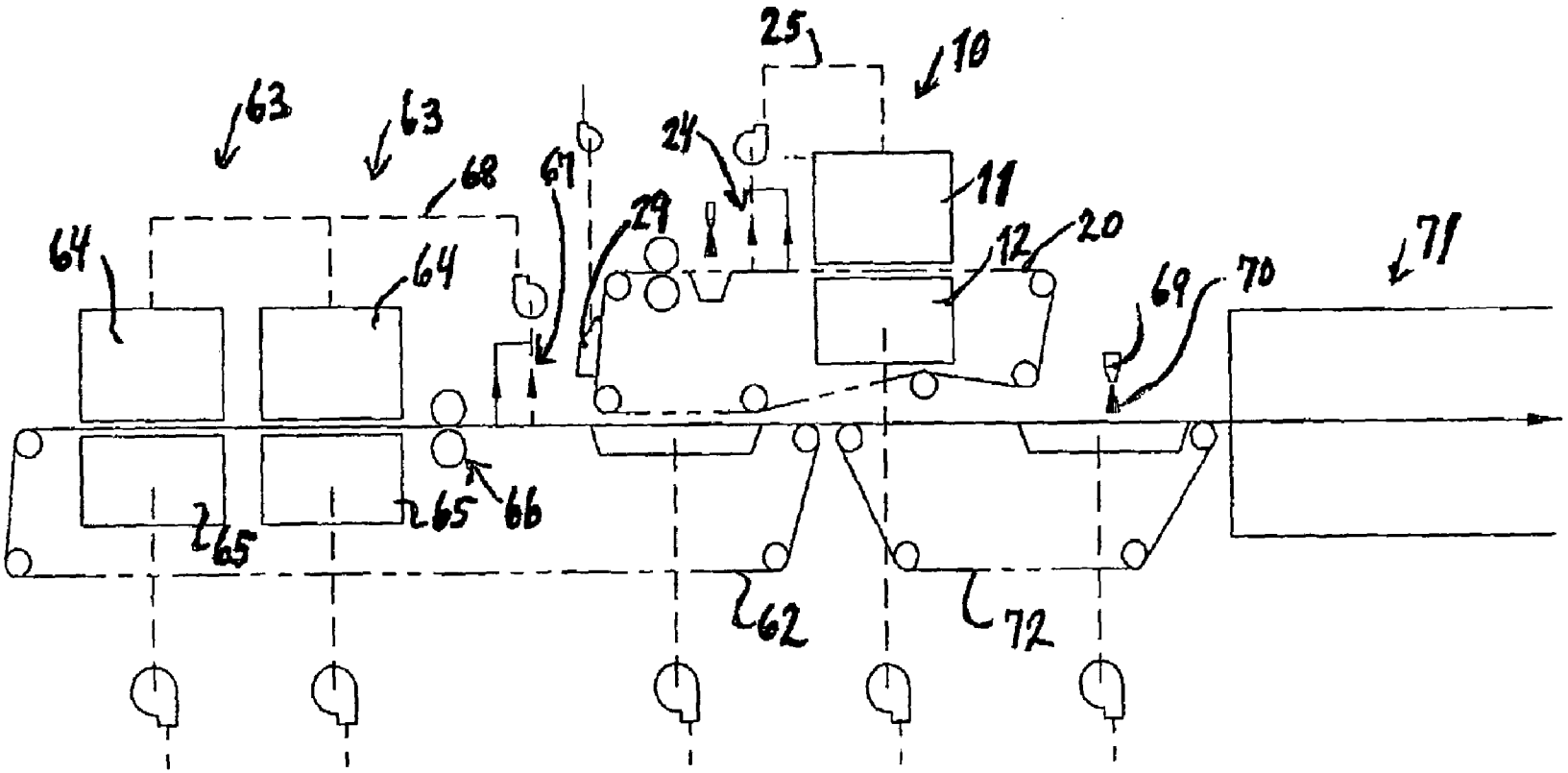
FIG. 8 shows an elementary sketch of a seventh embodiment of an apparatus according to the invention.

FIG. 8 shows the seventh embodiment where the conveyor wire is provided as a formerwire 62. Before the airformed fibre layer from the airlaying unit 10 is moved down on the formerwire 62, a layer is formed by using one or more preceding airlaying units 63. Each of these includes a formerhead 64 and a suction box 65. After these airlaying units 63 there is provided a compacting unit 66 and means 67 for edge trimming and which, via a return run 68, are moving scrap from edge trimming back to the formerheads 64.

With this apparatus it is possible to make a product where a first, or the two first layers, are formed and compacted so that a high density layer is attained. The third layer formed by the airlaying unit 10 may, however, be a low density layer. Such a product may be produced with cellulose and bicomponent fibres and superabsorbents from the formerheads 64. This will be very strongly compacted and is then provided with a liquid distribution layer from the airlaying unit 10, consisting of synthetic fibres and bi-component fibres which are relatively thick and have an open structure. I.e. the product allows that e.g. liquids coming on the top side of the outermost layer, will penetrate very quickly through the liquid distribution layer and down into the absorbing core in such a way that the surface is always felt dry.

By the manufacturing of the product, bonding may be performed in different ways. In FIG. 8 is illustrated a spray unit 69 for applying latex 70 which is dried subsequently in an oven 71. However, a thermobonding process or combination of latex and thermobonding may also be used, depending on the fibres used in the manufacturing process.

As alternative to the airlaying units 63, systems for spunbonding, meltblowing or carding may be used.

Figure 9:
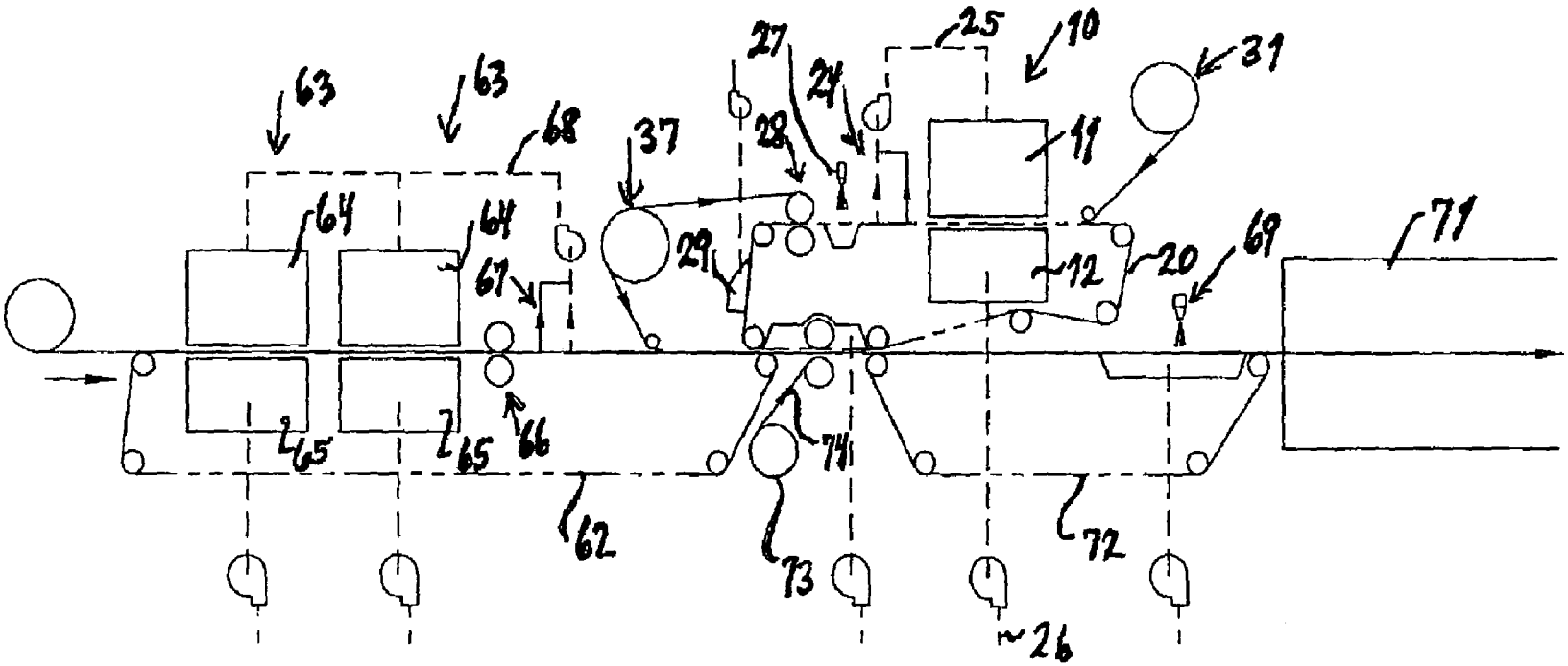
FIG. 9 shows an elementary sketch of a eighth embodiment of an apparatus according to the invention.

FIG. 9 corresponds in principle to FIG. 8. However, unwinding units 31 and 37 known from previous embodiments are here added. Also, here is provided an embosser 61 corresponding to the embosser shown in FIG. 7 at a position between the formerwire 62 and the subsequent conveyor belt 72. A further unwinding unit 73 is shown here, which e.g. can be used for unwinding a non-woven layer 74 which becomes laminated at the underside of the fabric when passed through the embosser 61. Thus it becomes possible to form different combinations of layers in the product. E.g. it will be possible to form a three-layer product with two non-woven layers at each side and a centre layer in the shape of an absorbing core which is formed by the airformed layer.

Figure 10:
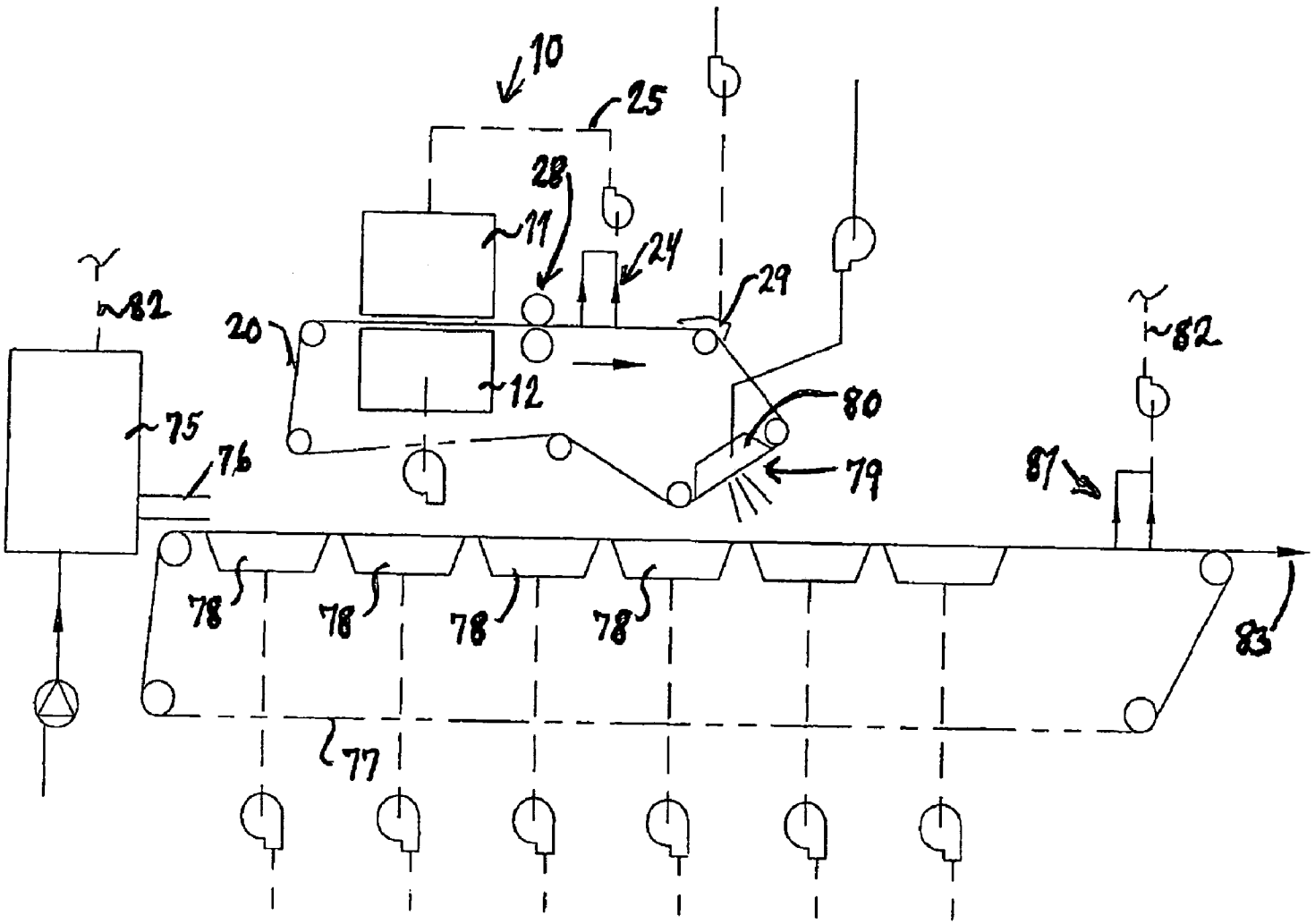
FIG. 10 shows an elementary sketch of a ninth embodiment of an apparatus according to the invention.

FIG. 10 shows a ninth embodiment based on a wetlaying process. Here, a head box 75 is used in which fibres are suspended in water so that e.g. 0.5-5% fibre solution appears. Via an outlet 76, this is blown out upon a formerwire 77 where a row of suction boxes 78 for removing water from the wetformed layer is provided. The airlaying unit 10 is disposed above the formerwire 77 in such a way that the formerwire 20 has an upper run running to the right as seen in FIG. 10. The airformed fibre layer is moved at the top side of the formerwire 20 to the area 79 where a blow box 80 is situated. The blow box 80 blows the fibres from the airformed fibre layer down upon the top side of the wetformed layer on the formerwire 77. At its top side, the formerwire 77 is provided with means 81 for edge trimming, and which via a return run 82 conveys fibres back to the head box 75. From the formerwire the multi-layer fabric 1 is conveyed further according to the arrow 83 to subsequent pressing stations and dryers.

With the plant illustrated in FIG. 10 it is possible to use a wetlaying process that is running with very great speed, e.g. up to 1500 m per minute. Hereby, it becomes possible to control the amount of fibres at the top side of the formerwire 77. It is thus not necessary to run so fast with the formerwire 20 upon which the airformed fibre layer is formed. E.g. there may be laid 50 g/m$^2$ on the formerwire 20, and from a relative calculation of the speed differences between the formerwires 20 and 77, it is possible to add greater or lesser amounts of dry fibres to the wet fibre layer.

The suction boxes 78 are used for sucking the dry fibres down against the wet fibre layer. By this apparatus it becomes possible to increase the concentration of dry fibres and hereby to reduce the relative humidity in the fibre web when it leaves the formerwire 77.

It may be an advantage to increase the concentration of dry fibres before the fibre web is conveyed to a subsequent pressing section or drying. Alternatively, it will also be possible to use the apparatus for adding synthetic fibres to the fibre layer. It may also be difficult to add synthetic fibres to a fibre mixture in the head box.

By experience, by a wetlaying process it will only be energy economical to perform vacuum suction until an about 50% dry matter content in the wet fibre layer is attained. After that, for energy economy reasons, drying/pressing is to be used. If a dry matter content of about 50% is attained upon the formerwire 77 immediately before the dry fibres are blown down from the section 79 of the above provided formerwire 20, it will be possible to add dry fibres for increasing the dry fibre concentration to 60-70% before the wet fibre web is led to pressing stations and water evaporation. Then is becomes possible to energy optimise the process as less energy is to be used for water evaporation in relation to the number of kilos produced on the plant.

Figure 11:
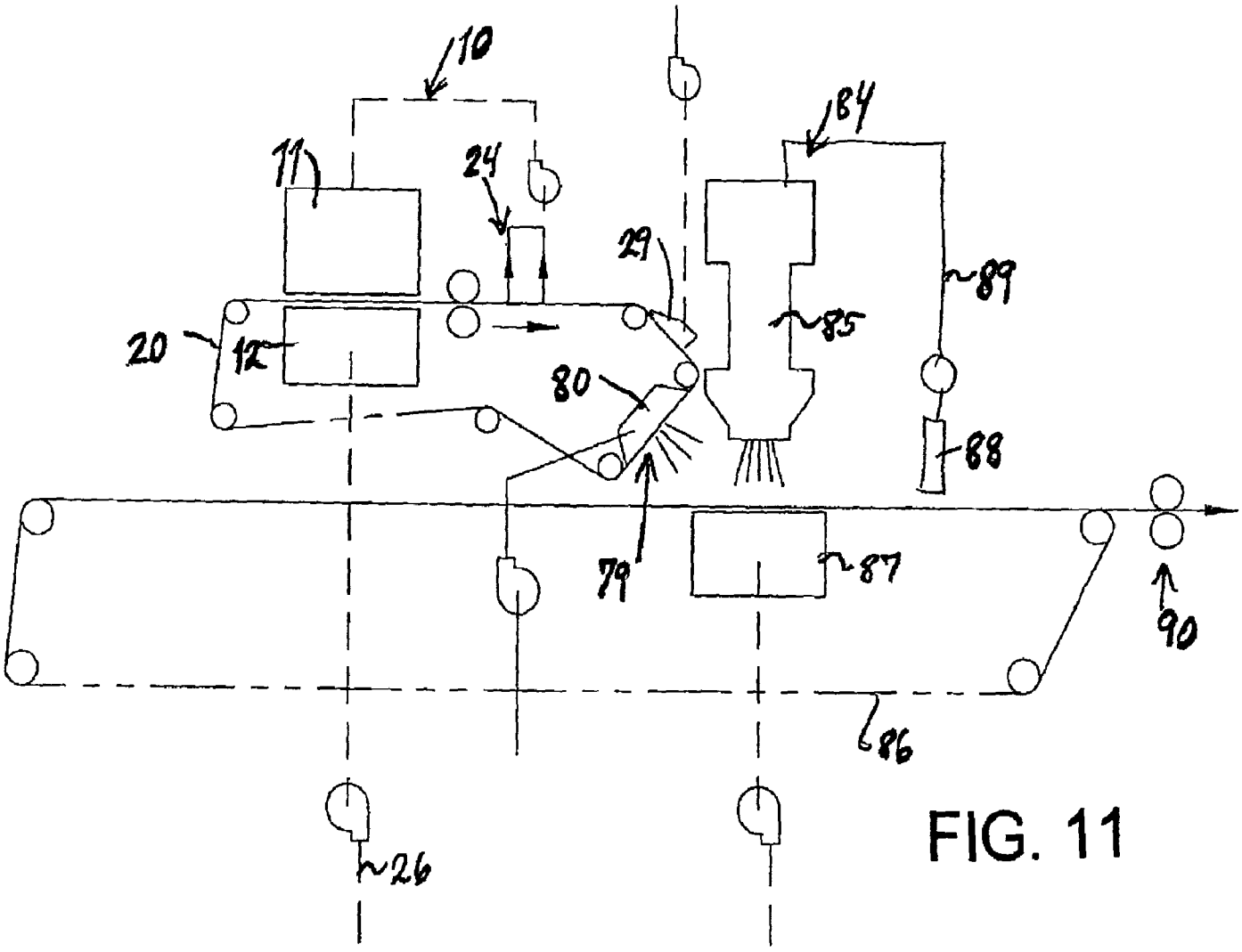
FIG. 11 shows an elementary sketch of a tenth embodiment of an apparatus according to the invention.

FIG. 11 illustrates a tenth embodiment including a meltblowing/spunbonding unit 84. The meltblowing/spunbonding unit 84 includes a meltblowing unit 85 which in principle corresponds to an extrusion head including a number of nozzles whereby fibres are formed which are laid directly on a meltblown formerwire 86. The meltblowing/spunbonding unit 84 furthermore includes a suction box 87 disposed opposite the meltblow heads 85 with the formerwire 86 provided therebetween. The apparatus shown in FIG. 11 furthermore includes a formerwire 20 which is designed as shown in FIG. 10, i.e. a formerwire having a section 79 in which is provided a blow box 80 blowing the fibres directly into the fibres that in melted form comes out from the meltblow head 85.

In practice it appears that the fibres from the airformed fibre layer formed on the formerwire 20 can be bonded to the fibres from the meltblow head 85 as long as these are in the melted condition. The formerwire 86 moves the formed fibre product past means 88 for edge trimming which are connected with an outlet 89 that removes the edge trimmings and conveys them back to recycling.

Then the formed multi-layer product is conveyed to finishing treatment units, e.g. a calander 90 as shown in FIG. 11.

It is noted that the speeds on the formerwire 20 for forming the airformed fibre layer and the formerwire 76 for forming the meltblowing layer may be different so that it is possible to perform dosing based on the speed difference as also explained in connection with FIG. 10.

Common to all above explained embodiments it is noted that the airformed fibre layer will usually include cellulose fibres, but as has been the case in connection with certain embodiments it is possible to form the airformed fibre layer by a combination of several fibres and possibly also super-absorbents. Common to all embodiments is the particular formerwire 20 with the airlaying unit 10 which is used for laying the fibres with the various differences desired. Furthermore, the suction unit 29 associated with the formerwire 29 is an important element in the invention. It is thus possible to remove all scrap from edge trimmings and all obsolete or wrongly disposed layers before the web/webs are continued in the process. Since the airlaying process is performed separately, i.e. the fibres sucked from suction boxes and from the suction unit 29 may be returned to the suction head 11 and be reused in the process.

This will not just be an advantage by start and stop of the process but also be an advantage in case of emergency shutdown. If something goes wrong during a production process, it is important to get the airformed fibre layer removed as quickly as possible. Thus situations where a layer is missing later in the process may arise. This may mean that in a spunlace system pure cellulose fibres appear together with a layer of carded fabric. If that is the case there will be great risk of blocking the plant which may imply a breakdown with up to 8-10 hours for the subsequent cleaning.

A substantial advantage by the invention is furthermore that the airformed fibre layer laid on an already formed layer does not make any requirements to whether the formed layer is wet, dry or sticky, or if it is permeable or not. Thus it is possible to lay the airformed fibre layer on any base formed in advance, irrespectively of properties in this previously formed layer, as mentioned by using a blow box enables bringing the fibres in contact with impervious layers for subsequent formation of an integrated multi-layer fabric 1.

Furthermore, it is also to be noted that there is a special advantage by the invention when the layer previously formed is wet. When that is the case, cellulose fibres will be laid upon a wet layer, e.g. a carding layer. When this happens, a certain pressure difference across the two layers will arise. Thus partial interference will arise between the cellulose fibre layer and the carding layer/bottom layer.

The formed product formed from prior art will not form a real stratification, however only a mixture of the bottom layer and the airformed fibre layers. This will at least be the case in the border area between the two layers. This mixing will occur because it is necessary to dry the carded fabric before the airformed fibre layer is laid on the bottom layer. This is not necessary according to the present invention, and the cellulose fibres from the airformed fibre layer will lie upon the wet bottom layer/carded layer.

Hereby the volume of the cellulose fibres will be increased as the cells of the cellulose fibres are filled with water. This implies that a clear separation occurs, providing a clearer stratification with different properties in the bottom layer/carded layer and the airformed fibre layer with cellulose fibres disposed upon it. By subsequent placing a third layer upon the two formed layers, it is thus possible to provide a third layer where the midmost layer is formed as a central layer and not as a partly mixture in the one of the outer layers. This furthermore means that less fibre loss occurs in a subsequent spunlacing unit.

For avoiding loss of fibres, by the prior art it has been common to choose as long fibres as possible and fibres with as few nits as possible. This means that special requirements have been made to the fibre supply. This is not necessary with the method according to the present invention when the fibre layer is formed on a wet web.

Reduced loss of fibres will thus occur by the subsequent spunlacing, contributing to the advantageous material saving. In traditional, combined processes with spunlacing, a fibre loss between 5% and 8% may occur. By using the present invention, it is possible to reduce this loss with ⅓ or more plus the possibility for reducing fibre loss by the airlaying process on the separate formerwire.

The typical cellulose loss will be loss of cellulose fibres which are washed out. These washed out cellulose fibres will normally end in a water cleaning facility where it is necessary to add chemicals for flocculating the cellulose fibres in order to get them to precipitate. Then they may be removed, e.g. by pressing filters. This material will be waste which usually is to be deposited.

The invention is thus not only advantageous by the direct economic saving at the production process but also provides an economic profit through reduced costs for handling waste from the manufacturing process.

Even if not shown above, the apparatus and the plant of which it forms a part will be provided with monitoring means that may monitor operational conditions and use the results of such monitoring for an automatic control of the layer forming units and edge trimming and suction means. Such control and monitoring systems will, however, be possible to design for a skilled in the art in light of the present description of the invention.

The invention claimed is:

1. Method for manufacturing a multi-layer fabric, including at least one fibre layer formed by airlaying combined with at least one further layer which is formed by different technologies, or combined with one or more films, and where the airforming is performed on a separate formerwire which is applied vacuum via a suction box disposed opposite to a formerhead, and where the airformed fibre layer is transferred to a conveyor wire for joining with additional layers, wherein edge trimming is performed at least on the airformed layer before it is joined with one or more other layers for forming the multi-layered fabric, and that the scrap from edge trimming and exhaust from the suction box is returned to the formerhead.

2. Method according to claim 1, wherein the airformed fibre layer is compacted before it is joined with the other layer or layers.

3. Method according to claim 1, wherein the airformed fibre layer is sucked from the separate formerwire and is returned to the formerhead at start/stop of the manufacturing process.

4. Method according to claim 1, wherein at least one web of a permeable material is laid upon the formerwire for forming an at least double layered fabric on the formerwire.

5. Method according to claim 1, wherein the airformed fibre layer is formed at the upper side of an upper run of the formerwire, and that the fibre layer is passed downwards and along the underside of the lower run of the formerwire in order to be laid off on the subsequent conveyor wire together with at least one other web for forming a fabric with at least two layers.

6. Method according to claim 1, wherein the individual layers joined on the conveyor wire are integrated by a suitable succeeding process.

7. Method according to claim 1, wherein an individual edge trimming of individual layers is performed before they are joined on the conveyor wire.

8. Apparatus for manufacturing a multi-layer fabric including at least one fibre layer formed by airlaying combined with at least one further layer which is formed by various technologies, or combined with one or more films, and where an airlaying unit including a formerhead and a suction box are associated with a separate formerwire, which apparatus including a conveyor wire upon which a plurality of layers can be combined with the airformed fibre layer, as several layer forming units are associated therewith, wherein the airlaying unit includes means for edge trimming of the airformed fibre layer formed on the separate formerwire, and that outlet from the suction box and means for collecting the scrap from edge trimming are connected with the formerhead for returning fibres.

9. Apparatus according to claim 8, wherein there is provided a compacting unit, and optionally also a moisturising unit, immediately after the airlaying unit on the separate formerwire.

10. Apparatus according to claim 8, wherein a suction unit is provided at the separate formerwire, and that an outlet from that is connected with the formerhead.

11. Apparatus according to claim 8, wherein in connection to the formerhead, a unwinding unit is provided for laying a web on the separate formerwire, so that thereupon is formed an at least double-layered fabric.

12. Apparatus according to claim 8, wherein the forrnerhead used by forming the airforrned fibre layer, that at least one formerhead is disposed at the upper side of the upper run of the formerwire, and that a vacuum box is provided between the upper and lower runs of the formerwire so that the fibre layer is passed downwards and along the underside of the lower run of the formerwire in order to be laid off on the subsequent conveyor wire together with at least one other web for forming a fabric with at least two layers.

* * * * *